US007977880B2

(12) United States Patent
Horiuchi et al.

(10) Patent No.: US 7,977,880 B2
(45) Date of Patent: Jul. 12, 2011

(54) PLASMA DISPLAY PANEL AND PLASMA DISPLAY APPARATUS

(75) Inventors: Naohiro Horiuchi, Saitama (JP); Kenji Okishiro, Kawasaki (JP); Go Saitou, Mobara (JP)

(73) Assignee: Hitachi, Ltd., Tokyo (JP)

( * ) Notice: Subject to any disclaimer, the term of this patent is extended or adjusted under 35 U.S.C. 154(b) by 280 days.

(21) Appl. No.: 12/222,774

(22) Filed: Aug. 15, 2008

(65) Prior Publication Data

US 2009/0153049 A1 Jun. 18, 2009

(30) Foreign Application Priority Data

Dec. 14, 2007 (JP) ..... 2007-322811

(51) Int. Cl.
*H01J 17/49* (2006.01)

(52) U.S. Cl. ..... 313/582

(58) Field of Classification Search ..... 313/490–494, 313/582–587

See application file for complete search history.

(56) References Cited

U.S. PATENT DOCUMENTS 5,939,826 A * 8/1999 Ohsawa et al. ..... 313/582
5,957,743 A * 9/1999 Konishi et al. ..... 445/24
6,611,099 B1 * 8/2003 Murata et al. ..... 313/582

FOREIGN PATENT DOCUMENTS

JP 11-204044 1/1998
JP 2000-11885 6/1998

* cited by examiner

*Primary Examiner* — Toan Ton
*Assistant Examiner* — Hana S Featherly
(74) *Attorney, Agent, or Firm* — Stites & Harbison PLLC; Juan Carlos A. Marquez, Esq.

(57) ABSTRACT

A plasma display panel is provided with a discharge cell comprising a discharge space, a phosphor film contacting with the discharge space, a holding portion (barrier ribs and a dielectric layer) sectioning the discharge space and holding the phosphor film on an opposite side to the discharge space side, and gas filled in the discharge space and emitting ultraviolet light by discharge. The phosphor film comprises a phosphor layer emitting visible rays by excitation caused by ultraviolet light and a reflecting layer reflecting visible rays, the phosphor layer is provided between the reflecting layer and the discharge space, a film thickness of the reflecting layer is 15 μm or thinner, and a refractive index of the reflecting layer is 1.7 or higher.

16 Claims, 15 Drawing Sheets

PLASMA DISPLAY PANEL AND PLASMA DISPLAY APPARATUS

CROSS-REFERENCE TO RELATED APPLICATION

The present application claims priority from Japanese Patent Application No. JP 2007-322811 filed on Dec. 14, 2007, the content of which is hereby incorporated by reference into this application.

TECHNICAL FIELD OF THE INVENTION

The present invention relates to a plasma display panel and a plasma display device using the same, and in particular to an effective technique applied to a phosphor film comprising a two-layered structure comprising a phosphor layer and a reflecting layer.

BACKGROUND OF THE INVENTION

A plasma display device is utilized as a thin-model flat display with a large screen for various applications such as a television or an outdoor display panel. Currently, development of the plasma display device has been advanced toward further high performance, especially, higher luminance or higher efficiency in order to achieve improvement of further display characteristic.

In recent year, in a market surrounding such a plasma display device, performance competition comprising another thin-model flat display such as a liquid crystal display is very keen. The plasma display device is especially required to have higher luminance and higher efficiency, and it is also required to be full HD (High Definition) compliant in the future.

Japanese Patent Application Laid-Open Publication No. H11-204044 (Patent Document 1) discloses a technique where a phosphor layer is disposed over barrier ribs and a back plate face and a visible ray reflecting layer is disposed between the back plate, and the phosphor layer so that transmittance of the phosphor layer to visible rays is averagely higher on the visible ray reflecting layer than on the barrier rib, in order to obtain a plasma display device having high light emitting efficiency and luminance to a size of a discharge cell.

Japanese Patent Application Laid-Open Publication No. 2000-11885 (Patent Document 2) discloses a technique where a reflecting layer containing a white material (for example, $TiO_2$) is formed on side wall faces of barrier ribs and a bottom face positioned between adjacent barrier ribs, in order to obtain a plasma display device where luminance is improved, while poor withstand voltage is prevented and luminance becomes even regarding red, green, and blue.

SUMMARY OF THE INVENTION

A problem to be solved by the present invention lies in that higher luminance is achieved in a plasma display panel and a plasma display device, and higher luminance (higher efficiency) in full HD (High Definition) compliance is achieved therein. Higher luminance (higher efficiency) of a plasma display panel and a plasma display device has been examined variously and various means for achieving the higher luminance (higher efficiency) have been proposed for some time.

For example, as shown in Japanese Patent Application Laid-Open Publication No. H11-204044 (Patent Document 1) or Japanese Patent Application Laid-Open Publication No. 2000-011885 (Patent Document 2), there is such a trial or proposal that a layer with a high reflectivity (a reflecting layer) is provided between a layer made from a phosphor material (phosphor layer) and a holding portion, and visible rays from a phosphor are efficiently reflected by the reflecting layer so that visible rays are emitted efficiently, which results in realization of higher luminance.

However, even if a two-layered structure comprising the phosphor layer and the reflecting layer is adopted, luminance may lower due to a film thickness condition of the reflecting layer and physical properties of the reflecting layer under the condition. In order to realize the higher luminance, it is necessary to clarify a relationship between the film thickness of the reflecting layer or physical properties of a material configuring the reflecting layer and optical characteristics to optimize respective conditions.

Achieving higher luminance of the full HD compliant plasma display device is an important problem to be solved by the invention. A size of the discharge cell in the full HD compliant plasma display panel is small. For example, when comparison between sizes of discharge cells in a screen lateral direction is performed, a size of a discharge cell in 42 inch XGA (Extended Graphics Array) plasma display panel is about 300 μm while that in a 42 inch full HD compliant plasma display panel is about 160 μm. Thus, according to reduction of the cell size, a discharge space becomes small, so that lowering of light emitting efficiency (lowering of luminance) may occur. Therefore, rising of the light emitting efficiency toward the full HD will be one of essential development techniques in the future.

An object of the present invention is to provide a technique which can improve luminance of a plasma display panel.

The above and other objects and novel characteristics of the present invention will be apparent from the description of this specification and the accompanying drawings.

The typical ones of the inventions disclosed in this application will be briefly described as follows.

According to an embodiment of the present invention, there is provided a plasma display panel where a phosphor film formed on a phosphor film holding portion comprises two layers of a phosphor layer and a reflecting layer, the phosphor layer is disposed nearer a discharge space than the reflecting layer, a film thickness of the reflecting layer is 15 μm or less, and the reflective index of a material configuring the reflecting layer is at least 1.7 or more.

The effects obtained by typical aspects of the present invention will be briefly described below.

According to the embodiment, luminance of a plasma display panel can be improved.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

In this application, the term "phosphor layer (phosphor portion)" indicates a layer (portion) having a function of converting ultraviolet light to visible rays to emit light, and the term "reflecting layer (reflecting portion)" indicates a layer (portion) having a function of reflecting visible rays emitted from a phosphor toward a discharge space side. In this application, the term "phosphor film" indicates a film configured to comprise phosphor, and it is discriminated from the term "phosphor layer". In the text, two "front substrate" and "rear substrate" configuring a plasma display panel will be explained such that a substrate serving as a display face through which emitted rays from the phosphor pass is the front substrate and a substrate which does not serve as the display face is the rear substrate when both the substrates are assembled as a panel.

First Embodiment

Figure 1:
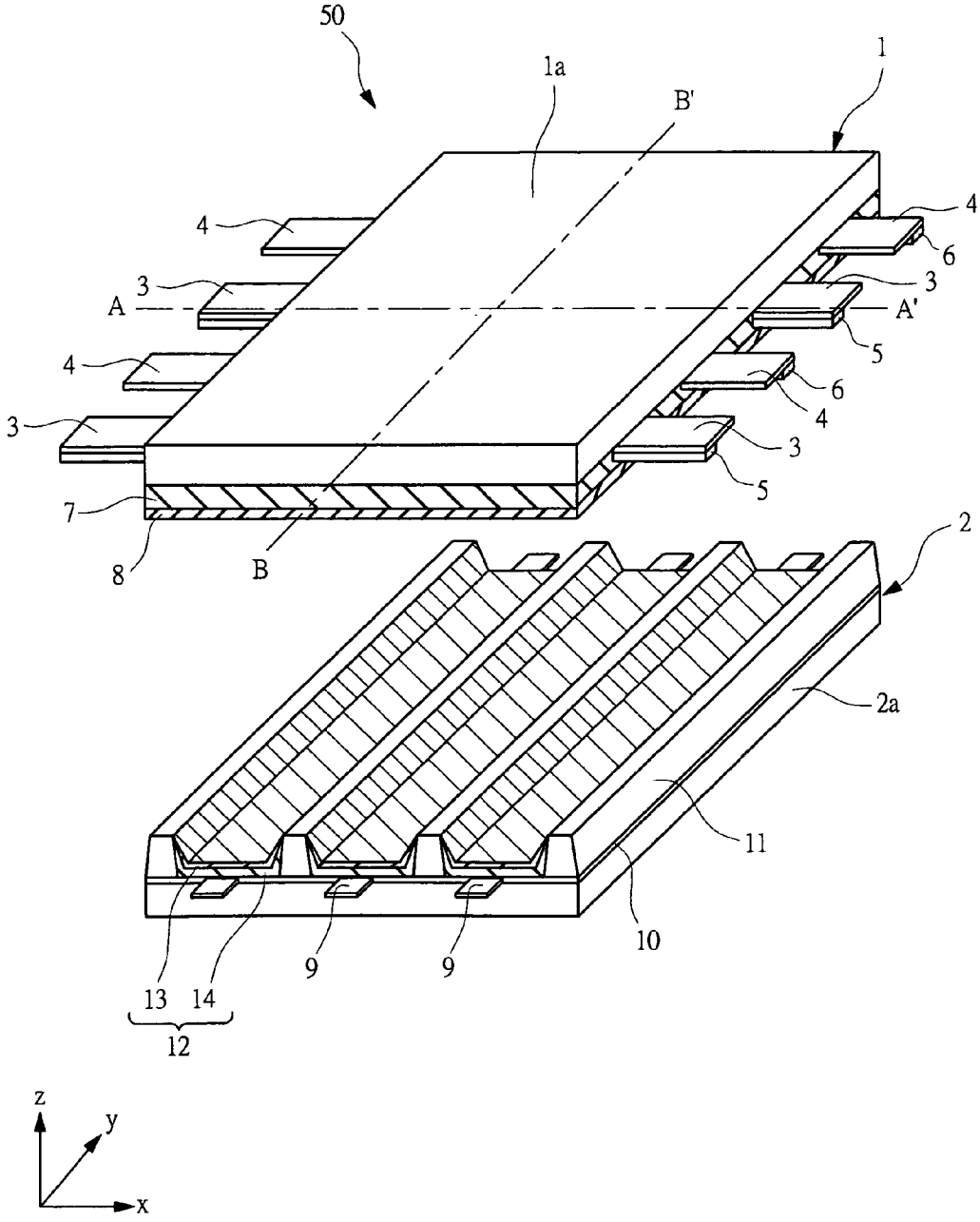
FIG. 1 is a perspective view schematically showing a main part of a plasma display panel according to an embodiment of the present invention.
Figure 2:
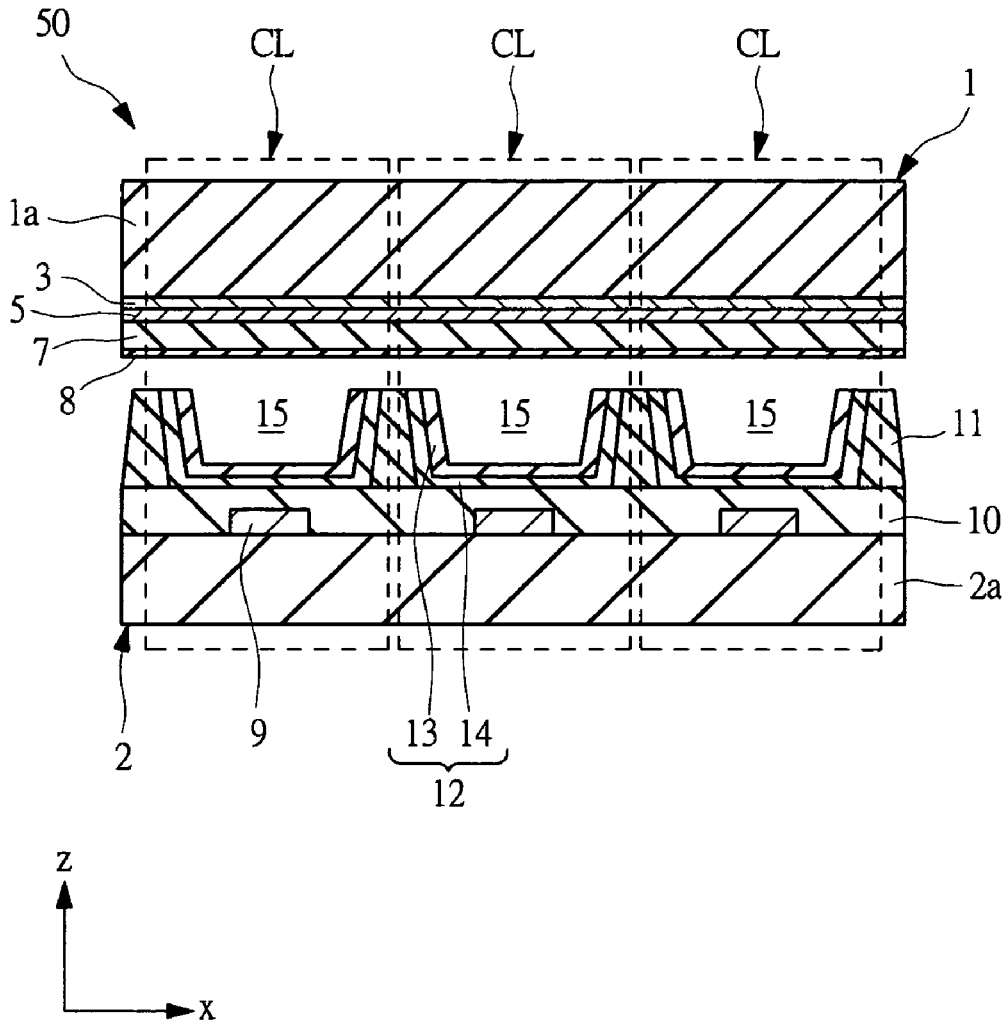
FIG. 2 is a cross-sectional view of the plasma display panel along the line A-A' in FIG. 1.
Figure 3:
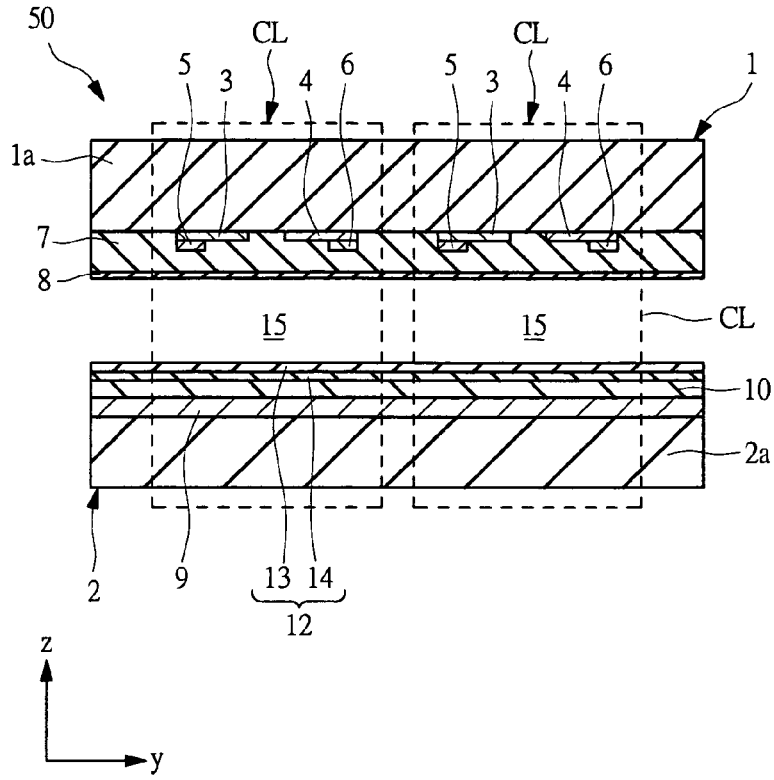
FIG. 3 is a cross-sectional view of the plasma display panel along the line B-B' in FIG. 1.

A structure of a plasma display panel 50 according to the present embodiment will be first explained. FIG. 1 is a perspective view schematically showing a main part of the plasma display panel 50 according to the embodiment, FIG. 2 is a cross-sectional view of the main part along the line A-A' in FIG. 1, and FIG. 3 is a cross-sectional view of the main part along the line B-B' in FIG. 1. The plasma display panel 50 is configured in a unit by bonding a front substrate 1 and a rear substrate 2 sharing an x-y plane and having a thickness in a z direction such that the substrates are opposed to each other. Note that, in FIGS. 1 to 3, the front substrate 1 and the second substrate 2 are illustrated so as to be separated from each other for easy understanding of a structure.

The plasma display panel 50 is an AC surface discharge type having a plurality of discharge cells CL, and display discharge is generated between a pair of electrodes (sustain electrodes) provided on one and the same substrate (the front substrate 1) so that alternate current (AC) driving is performed. A feature of the AC surface discharge type lies in that a structure is simple and reliability is excellent.

The front substrate 1 comprises, on a glass substrate 1*a*, a pair of sustain electrodes (also called "display electrodes") disposed in parallel so as to be spaced from each other by a fixed distance on an opposite face to the rear substrate 2. The pair of sustain electrodes comprises an X electrode 3 which is a common electrode and a Y electrode (a gate electrode) 4 which is an independent electrode and they are provided to extend in an x direction. The X electrode 3 and the Y electrode 4 are made from a transparent conductive material such as, for example, ITO (Indium Tin Oxide) for taking out light emission. An opaque X bus electrode 5 and an opaque Y bus electrode 6 for supplementing conductivity are provided to contact with the X electrode 3 and the Y electrode 4 and extend in the x direction, respectively. The X bus electrode 5 and the Y bus electrode 6 are made from a low resistive material such as, for example, silver, copper or aluminum.

The X electrode 3, the Y electrode 4, the X bus electrode 5, and the Y bus electrode 6 are insulated from discharging for AC driving, and these electrodes are covered with a dielectric layer 7. The dielectric layer 7 is made from a transparent insulator material such as, for example, a glass material containing $SiO_2$ or $B_2O_3$ as a main component for protecting the electrodes and forming wall charges on a surface of the dielectric layer to impart a memory function on the dielectric layer at a discharge time. The dielectric layer 7 is covered with a protective film 8 for preventing damage due to discharging. The protective film 8 is made from a material, for example, magnesium oxide (MgO).

The rear substrate 2 comprises, on a glass substrate 2*a*, an address electrode 9 provided so as to face the front substrate 1 and to extend in a Y direction such that the address electrode 9 grade separates the X electrode 3 and the Y electrode 4 on the front substrate 1. The address electrode 9 is covered with a dielectric layer 10 for insulating the address electrode 9 from discharging.

A barrier rib 11 sectioning a space between the adjacent address electrodes 9 (insulating the adjacent address electrodes 9 from each other) is provided on the dielectric layer 10 in a stripe manner in the same y direction as the address electrode 9 in order to prevent spreading of discharge (define a region for discharge). The barrier rib 11 is made from a transparent insulator material such as a glass material containing, for example, $SiO_2$ or $B_2O_3$ as a main component. In the plasma display panel 50, a pitch between the adjacent barrier ribs 11 is made smaller according to further high definition. For example, in the 42-type full HD compliant plasma display panel, the pitch is set to about 160 μm.

Respective phosphor films 12 emitting red, green, and blue are provided on a region on each address electrode 9 sectioned between the adjacent barrier ribs 11 so as to cover side faces between the barrier ribs 11 and a surface of the dielectric layer 10 (a groove face between the barrier ribs 11). Therefore, since the barrier rib 11 and the dielectric layer 10 have a function to hold the phosphor film 12, they serve as phosphor film holding portions.

The phosphor film 12 comprises two layers of a phosphor layer 13 emitting visible rays according to excitation performed by ultraviolet light and a reflecting layer 14 reflecting visible rays, and the phosphor layer 13 is provided on the reflecting layer 14 provided on the phosphor film holding portion. Thus, the phosphor film 12 comprises the phosphor layer 13 which is a phosphor portion contacting with the discharge space 15 and the reflecting layer 14 which is a reflecting portion contacting with the phosphor layer 13 on an opposite side of the phosphor layer 13 to the discharge space 15. That is, the phosphor layer 13 is provided between the reflecting layer 14 and the discharge space 15.

In the phosphor layer 13, for example, fine particles of blue phosphor $BaMgAl_{10}O_{17}$: $Eu^{2+}$, green phosphor $Zn_2SiO_4$: $Mn^{2+}$, and red phosphor (Y, Gd) $BO_3$: $Eu^{3+}$ are used as phosphor materials for blue, green, and red, respectively. As general notation of the phosphor material, a symbol before ":" indicates a host material composition, while a symbol after ":" indicates luminescence center, which means that atoms in a portion of the host material are substituted by the luminescence center. A reflecting portion material, for example, fine particles of titanium oxide ($TiO_2$) is used for the reflecting layer 14.

The front substrate 1 and the rear substrate 2 are disposed to face each other such that the pair of sustain electrodes (X electrode 3, Y electrode 4) on the front substrate 1 and the address electrode 9 on the rear substrate 2 side are approximately orthogonal to each other (they simply intersect each other in some cases), and the front substrate 1 and the rear substrate 2 are sealed by low melting point glass applied to peripheral portions of the substrates. The front substrate 1 and the rear substrate 2 are bonded to each other via a gap of about 100 μm. The gap configures the discharge space 15. Discharge gas (not shown) emitting vacuum ultraviolet rays by discharging between the X electrode 3 and the Y electrode 4 is filled in the discharge space 15, and the discharge gas comprises mixed gas (rare gas) such as, for example, Ne+Xe or He+Xe.

Thus, the plasma display panel 50 is simple regarding its structure, where discharge is caused in a desired discharge cell(s) of the plurality of discharge cells CL by selectively applying voltage to the sustain electrode pair (X electrode 3, Y electrode 4) on the front substrate 1 side and the address electrode 9 on the rear substrate 2 side. Vacuum ultraviolet rays are generated by the discharge and the phosphor films 12 (phosphor layer 13) of the respective colors are excited by the generated vacuum ultraviolet rays so that light emissions of red, green, and blue are caused and full color display is conducted.

Thus, the plasma display panel 50 is provided with the discharge cell CL comprising the front substrate 1, the rear substrate 2 disposed to face the front substrate 1, the discharge space 15 configured by a gap between the front substrate 1 and the rear substrate 2, the phosphor layer 13 (phosphor portion) contacting with the discharge space 15, the reflecting layer 14 (reflecting portion) contacting with the phosphor layer 13, the X electrodes 3 and the Y electrodes 4 provided on the front substrate 1, and the discharge gas filled in the discharge space 15.

Here, the phosphor film 12 comprising two layers of the phosphor layer 13 and the reflecting layer 14 in the embodiment will be explained in detail. First, the film thickness of the phosphor film 12 will be explained. For example, when the discharge space 15 for the discharge cell is reduced considering the full HD compliance, lowering of the ultraviolet light generation efficiency and rising of the driving voltage take place. This is undesirable for higher luminance of the plasma display panel 50. Therefore, in order to expand the discharge space as much as possible, it is proposed to thin the film thickness of the phosphor film 12 contacting with the discharge space 15.

A Debye length which is an indicator for maintaining discharge stably is in a range of about $10^{-6}$ m to $10^{-4}$ m, where a width of the discharge space is required to be at least 100 μm or more. In a display with the full HD and high definition, the discharge cell size for the full HD is about ½ of that in the XGA display, where the former discharge cell size is, for example, 160 μm in the x direction in FIG. 2. Therefore, when an average width of the barrier ribs 11 is set to about 40 μm, the upper limit of the film thickness of the phosphor film 12 is 20 μm in order to maintain discharge stably. This can be calculated according to ((discharge cell size−width of discharge space 15−with of barrier rib 11)/2). 20 μm which is the thickness of the phosphor film 12 is the upper limit of the HD compliant plasma display with high definition even when the phosphor film 12 comprises two layers of the phosphor layer 13 and the reflecting layer 14 like the embodiment and even when the phosphor film 12 comprises one layer of the phosphor layer 13.

Figure 4:
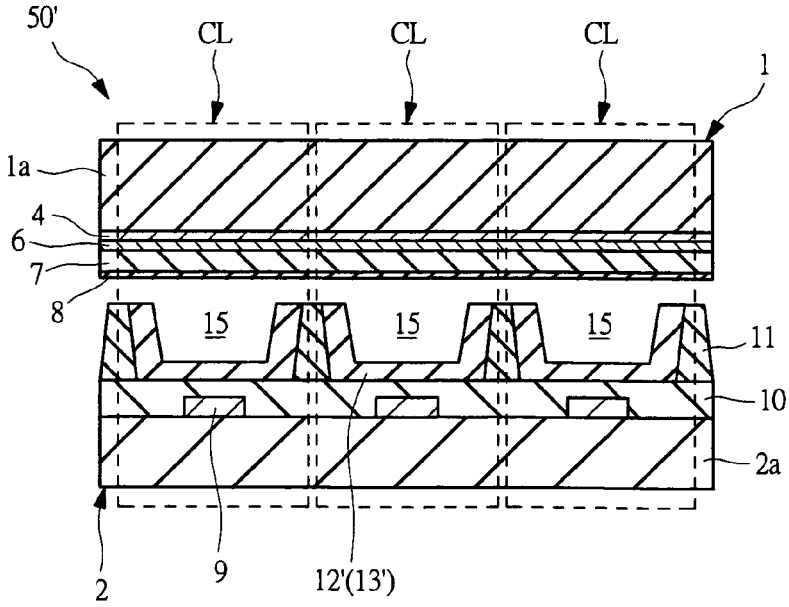
FIG. 4 is a cross-sectional view schematically showing a main part of a plasma display panel which has been examined by the present inventors.
Figure 5:
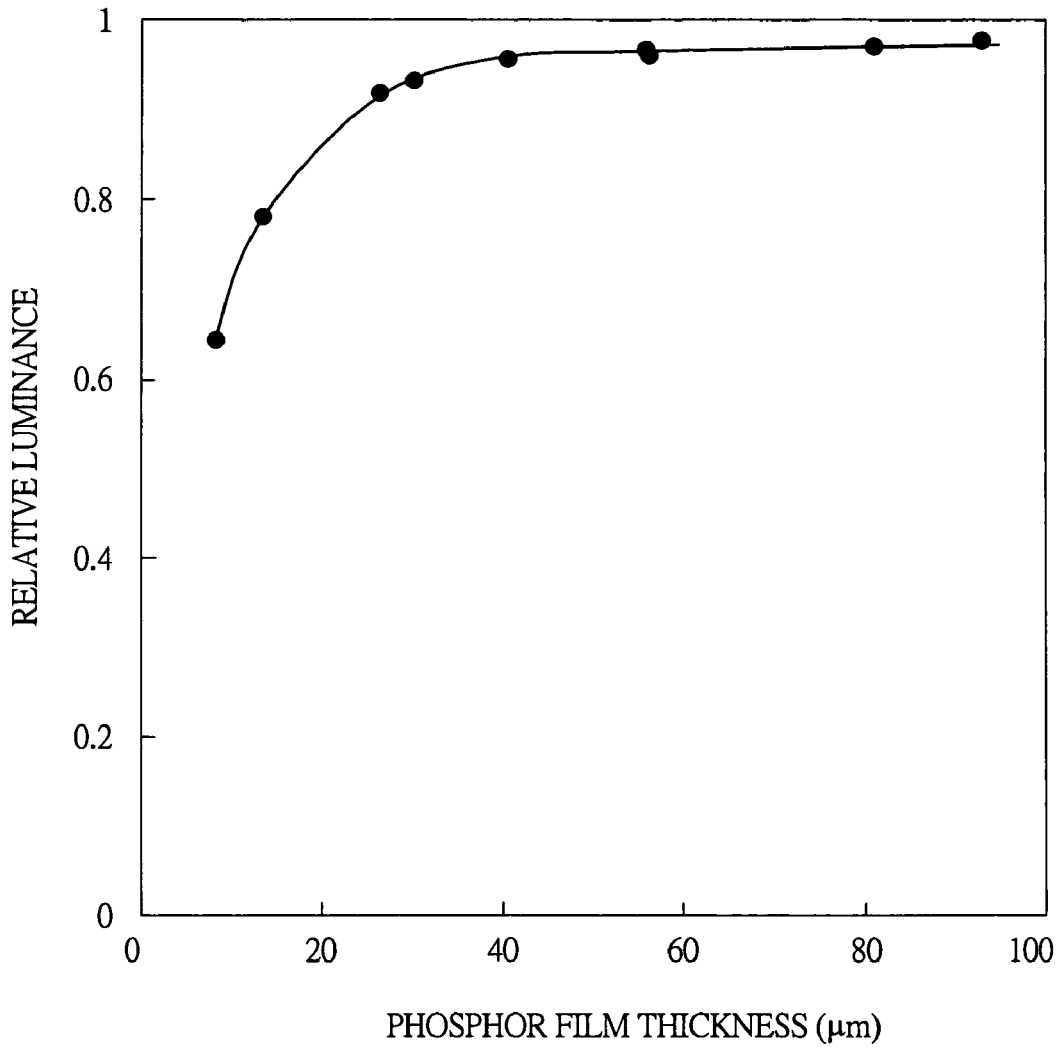
FIG. 5 is an explanatory diagram showing a relationship of a luminance to a film thickness of a phosphor film shown in FIG. 4.
Figure 6:
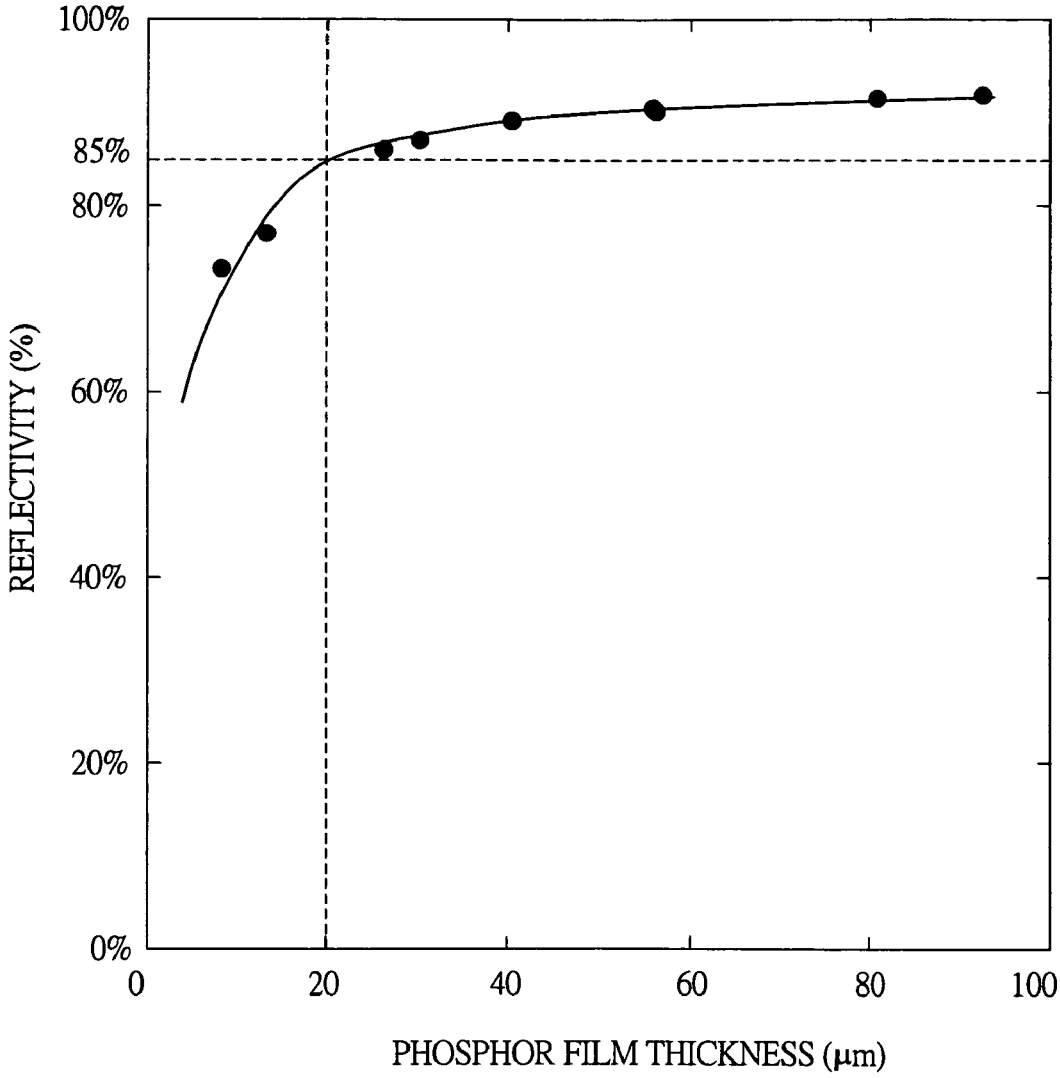
FIG. 6 is an explanatory diagram showing a relationship of a reflectivity to the film thickness of the phosphor film shown in FIG. 4.
Figure 7:
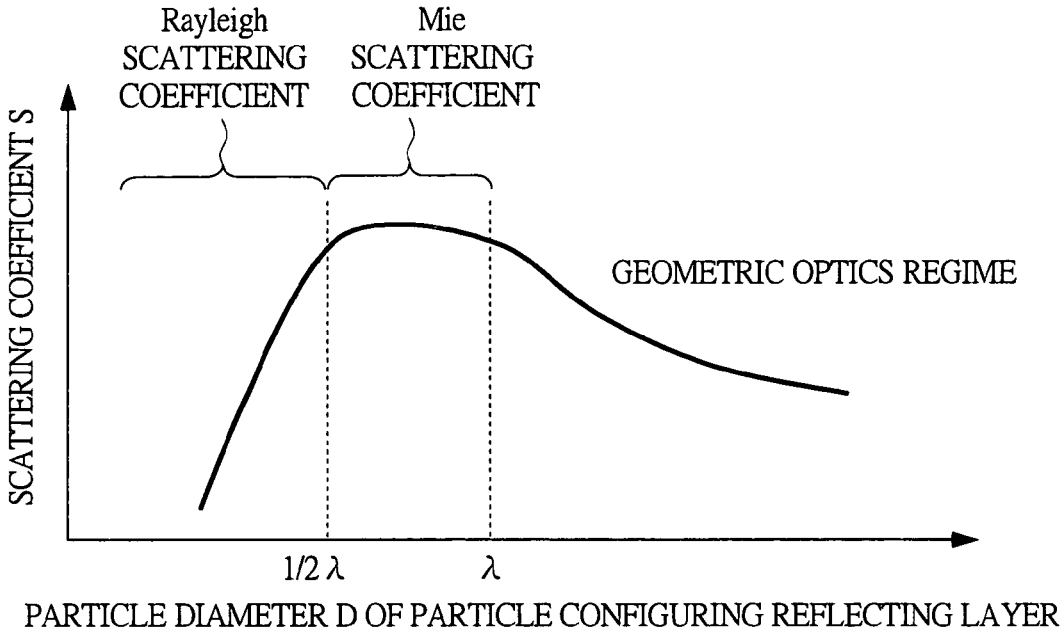
FIG. 7 is an explanatory diagram showing a relationship of a scattering coefficient to a particle diameter of a reflecting portion material.
Figure 8:
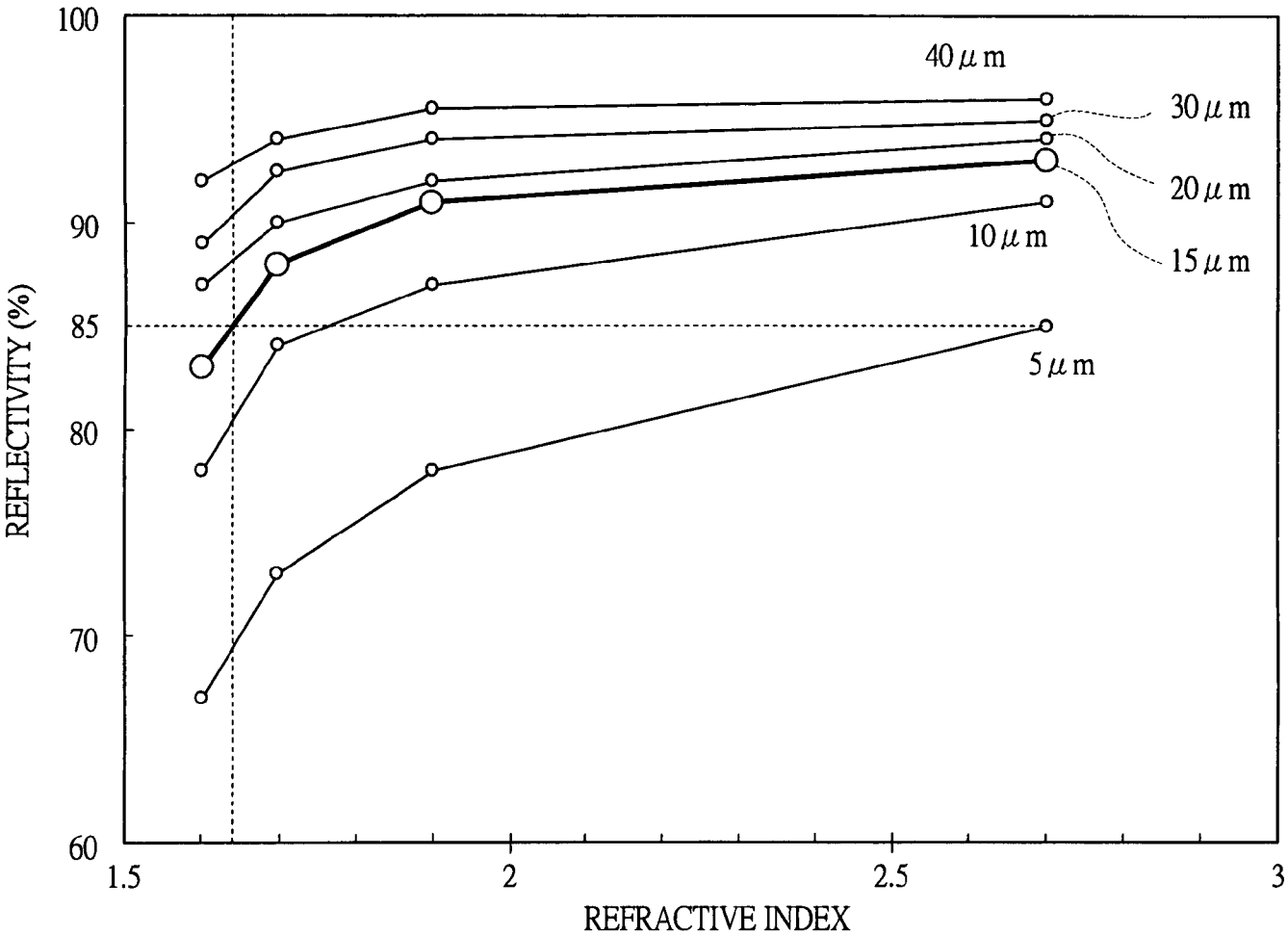
FIG. 8 is an explanatory diagram showing a relationship of the reflectivity to a refractive index of the reflecting portion material using a thickness of the reflecting layer as a parameter, where a wavelength is 550 nm.
Figure 9:
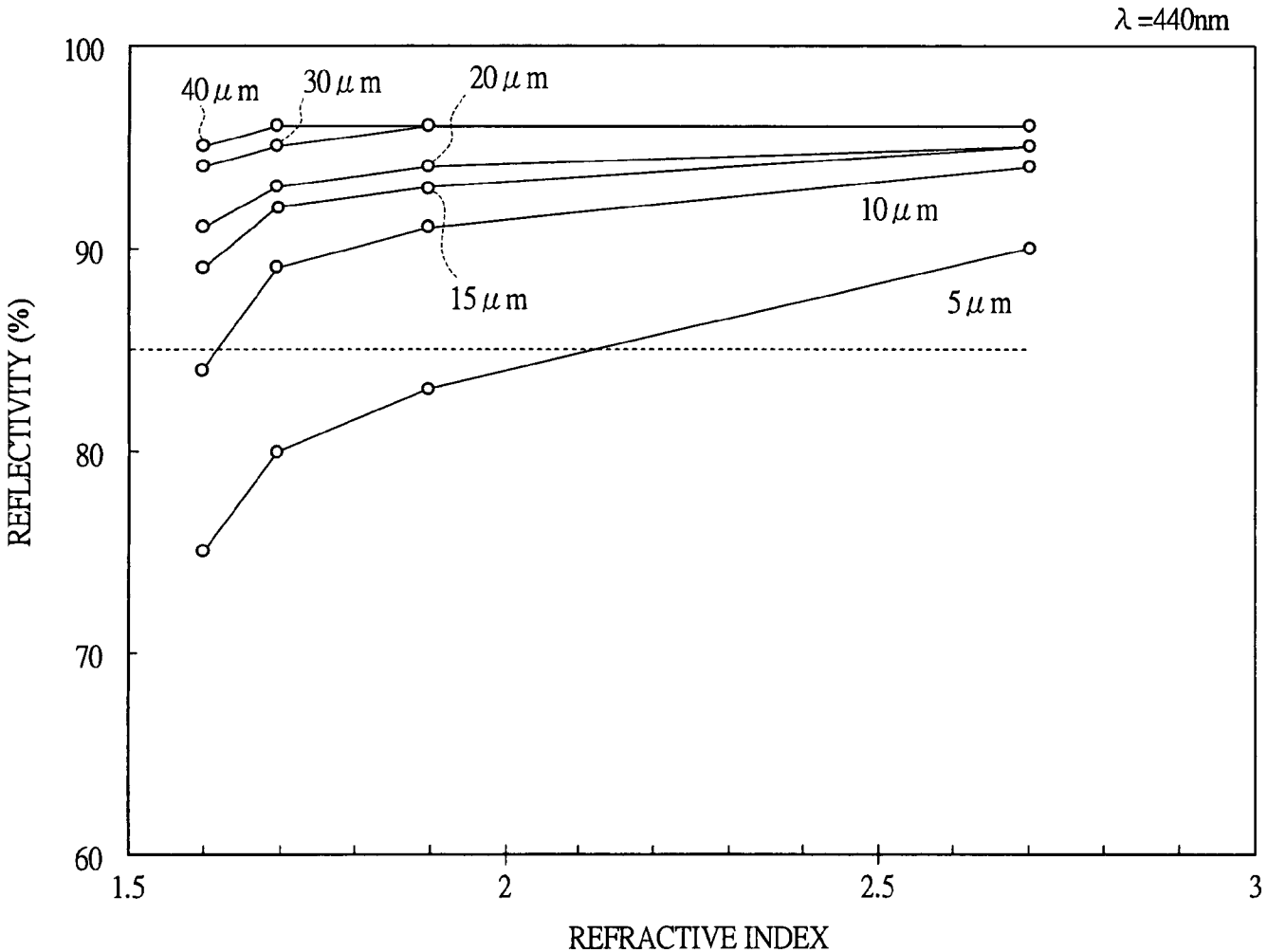
FIG. 9 is an explanatory diagram showing a relationship of the reflectivity to the refractive index of the reflecting portion material using the thickness of the reflecting layer as a parameter, where a wavelength is 440 nm.
Figure 10:
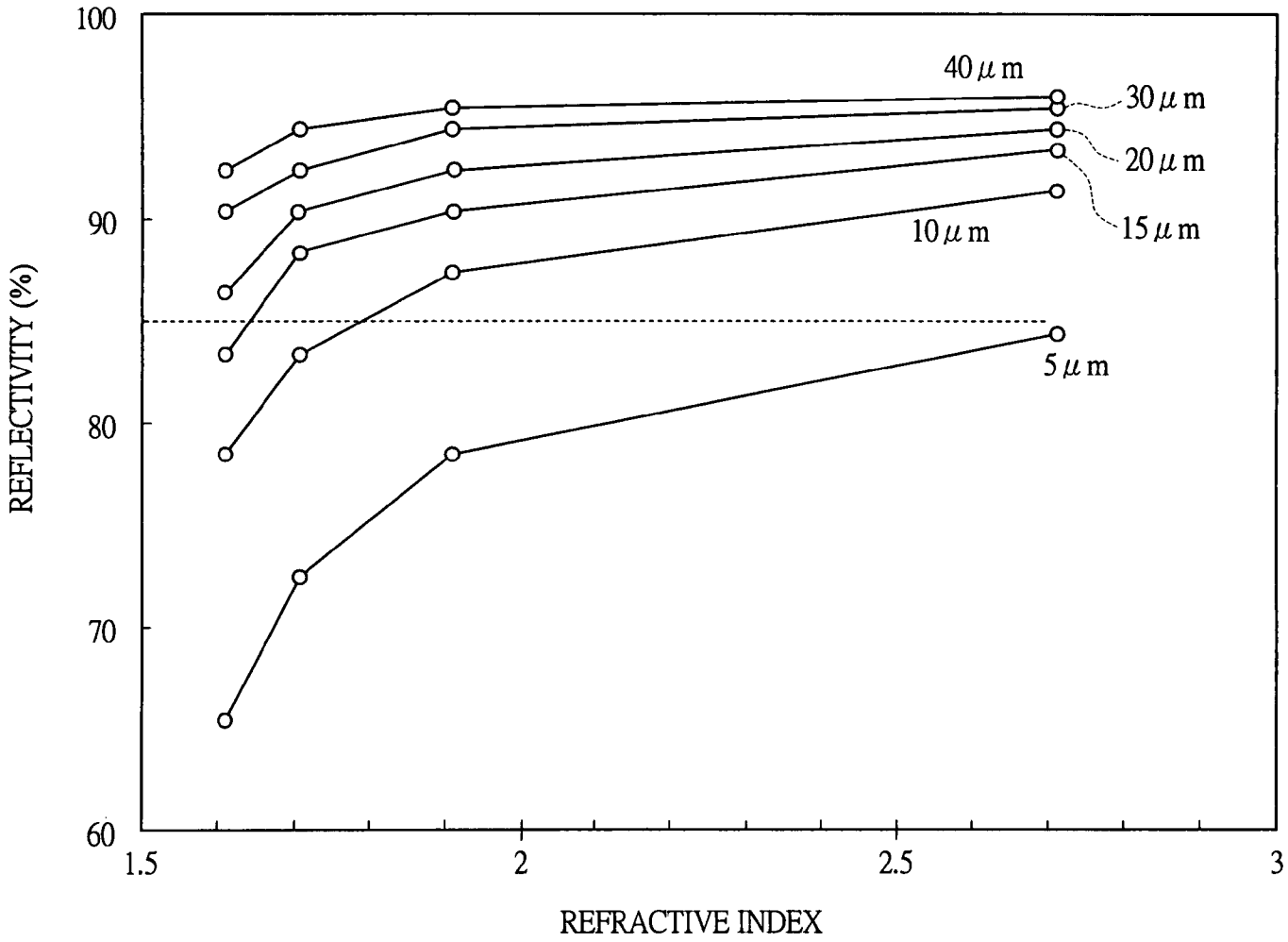
FIG. 10 is an explanatory diagram showing a relationship of the reflectivity to the refractive index of the reflecting portion material using the thickness of the reflecting layer as a parameter, where a wavelength is 600 nm.

Next, conditions of the reflecting layer 14 for improving luminance of the plasma display panel 50 will be explained with reference to FIGS. 4 to 10. FIG. 4 is a cross-sectional view schematically showing a main part of a plasma display panel 50' which has been examined by the present inventors, where the case where the plasma display panel 50' comprises one layer of a phosphor layer 13' (phosphor film 12') is shown, though the plasma display panel 50 shown in FIGS. 1 to 3 comprises the phosphor film 12 comprising two layers (the phosphor layer 13 and the reflecting layer 14). FIG. 5 is an explanatory diagram showing a relationship of a luminance to a film thickness of a phosphor film 12' shown in FIG. 4, and FIG. 6 is an explanatory diagram showing a relationship of a reflectivity to the film thickness of the phosphor film 12' shown in FIG. 4. FIG. 7 is an explanatory diagram showing a relationship of a scattering coefficient to a particle diameter of a reflecting portion material. FIGS. 8 to 10 are explanatory diagrams showing relationships of the reflectivity to a refractive index of the reflecting portion material using a thickness of the reflecting layer 14 as a parameter, where a wavelength is 550 nm, it is 440 nm, and it is 600 nm, respectively.

As shown in FIG. 4, in the plasma display panel 50', the phosphor film 12' comprises one layer of the phosphor layer 13'. Considering the abovementioned full HD compliant plasma display panel with a high definition, the film thickness of the phosphor film 12' is 20 μm. Since the phosphor film 12' comprises one layer of the phosphor layer 13', for example, fine particles of blue phosphor $BaMgAl_{10}O_{17}$: $Eu^{2+}$, green phosphor $Zn_2SiO_4$: $Mn^{2+}$, and red phosphor (Y, Gd) $BO_3$: $Eu^{3+}$ are used as phosphor materials for blue, green, and red, respectively, where titanium oxide ($TiO_2$) configuring the reflecting layer 14 is not used.

When the phosphor film 12' comprises one layer of the phosphor layer 13' in this manner, the light emitting luminance becomes lower than that in case that the film thickness is made more than 20 μm. Specifically, as shown in FIG. 5, when the film thickness of the phosphor film 12' (a single layer of the phosphor layer 13') is 30 μm or thicker, an approximately constant light emitting luminance is maintained, but the film thickness becomes thinner than 30 μm, the light emitting luminance lowers sharply. The cause of the luminance lowering can be explained when the function of the phosphor film 12' comprising fine particles of phosphor is broken down to two functions.

The first function is a light emitting function of converting ultraviolet light to visible rays to emit light. The other function is a reflecting function of emitting visible rays toward the discharge space 15 side. When the film thickness of the phosphor film 12' is thick, ultraviolet light generated in the discharge space 15 reaches a portion (light emitting portion) with a light emitting function sufficiently but it does not reach sufficiently a portion (reflecting portion) with a reflecting function which is a lower region positioned below the phosphor film 12'. That is, it is considered that the lower region does not play the light emitting function but it plays the reflecting function. Therefore, when the film thickness of the phosphor film 12' becomes thin such as, for example, 20 μm, the reflecting function is lowered so that the luminance of the phosphor film 12' is lowered.

Thus, the cause of lowering of luminance due to thinning of the phosphor film 12' lies in lowering of the reflecting function of the phosphor film 12', when the film thickness of the phosphor film 12' becomes 20 μm or thinner, the reflectivity starts sharp lowering so that the reflectivity of the phosphor film 12' becomes 85% or lower, as shown in FIG. 6. Therefore, in view of the reflecting function of the phosphor layer 12', it is required for higher luminance that the reflecting function of the reflecting layer 14 provided according to the embodiment is higher than the reflecting function of the lower region of the thick phosphor film 12' having the thickness of, for example, 60 μm. In other words, the reflectivity of the reflecting layer 14 (reflecting portion) is required to be higher than the reflectivity of the lower region of the phosphor film 12', and it is required to be 85% or higher.

It is considered that the lower region of the phosphor film 12' playing the reflecting function is not required to be made from a phosphor material and it is preferably replaced by a material with a higher reflecting ability. Therefore, focusing attention on two functions of the phosphor film 12' due to a different in thickness, a higher luminance is achieved in the embodiment by conducting partition into the phosphor portion and the reflecting portion which have their respective functions to configure the phosphor film 12 as a two-layered structure of the phosphor layer 13 and the reflecting layer 14, and using the reflecting layer (reflecting portion) satisfying the optimal condition.

The condition for configuring the phosphor film 12 to the two-layered structure to realize the higher luminance will be explained below. The phosphor layer 13 comprising phosphor particles is required to have at least two layers of phosphor particles averagely in order to fulfill the light emitting function. If an average particle diameter of the phosphor is in a range of 2 to 3 μm, the phosphor layer 13 must have a thickness of at least 5 μm or more. When the film thickness is less than 5 μm, the phosphor particles in the phosphor layer 13 are sparse and ultraviolet light from the discharge space 15 passes through the phosphor layer 13 without being converted to visible rays so that the phosphor layer 13 does not fulfill the light emitting function.

As described above, since the maximum value which the film thickness of the phosphor film 12 can take for securing the discharge space 15 is 20 μm and the film thickness of the phosphor layer 13 required for emitting light is 5 μm or more, the film thickness of the reflecting layer 14 must be 15 μm or thinner.

As described above, the reflectivity of the reflecting layer 14 is required to be higher than that of the lower region of the phosphor film 12'. Reflection of visible rays conducted by the reflecting layer 14 is caused by scattering of visible rays conducted by particles configuring the reflecting layer 14. The relationship between a particle diameter D and a scattering coefficient S is shown in FIG. 7. Here, the scattering coefficient S means a ratio of light which has entered a reflecting layer scattered when it advances in the reflecting layer by a unit length. A higher reflectivity can be obtained with a thinner film thickness as the scattering coefficient S becomes larger. Note that, in the embodiment, particles configuring the reflecting layer are made from titanium oxide ($TiO_2$).

As shown in FIG. 7, the scattering coefficient S reaches the maximum when the particle diameter D is in a range of about half wavelength to one wavelength. Since the reflecting layer 14 must fulfill a function of reflecting visible rays, the term "wavelength" here means a wavelength of visible rays and it is in a range of 360 nm to 800 nm. That is, it is desirable that an average particle diameter Dm of particles configuring the reflecting layer 14 is in a range of 180 nm to 800 nm. Note that, the term "particle diameter" indicates an optical particle diameter and the term "average particle diameter" indicates a number average diameter of optical particle diameters. This number average diameter can be measured using optical diffraction/scattering method.

From this, when the average particle diameter of fine particles contained in the reflecting layer 14 (reflecting portion) is set in a range of 180 nm to 800 nm and the reflectivity of the reflecting layer 14 (reflecting portion) to visible rays is set to 85% or more, luminance of the plasma display panel 50 can be improved even if the phosphor layer 13 is thinned (for example, 5 μm).

FIGS. 8 to 10 are explanatory diagrams showing a relationship of a reflectivity to a refractive index of a reflecting portion material using the thickness (5, 10, 15, 20, 30, and 40 μm) of the reflecting layer 14 as a parameter, showing that a wavelength within visible rays is 550 nm (green), 440 nm (blue) and 600 nm (red), respectively. An average particle diameter of particles configuring the reflecting layer 14 at this time is in a range of 180 nm to 800 nm, as described above. Note that, FIGS. 8 to 10 show 85%-lines of the reflectivity when the film thickness of the phosphor film 12' which does not contain the reflecting layer 14 is 20 μm.

As shown in FIGS. 8 to 10, it is understood that, even if the film thickness of the reflecting layer 14 and the wavelength within visible rays are varied, the reflectivity increases according to increase of the film thickness of the reflecting layer 14. Human eyes to light emitted from the plasma display panel 50 depend on wavelength and they have the highest sensitivity to green with a wavelength of 555 nm, as shown in the so-called relative luminosity curve. Therefore, in order to achieve a higher luminance of the plasma display panel 50, to find the optimal condition of the reflecting layer 14 to the wavelength of 550 nm is considered effective.

As described above, when the full HD compliance is adopted, the maximum film thickness which the reflecting layer 14 can take is 15 μm, considering that the upper limit of the thickness of the phosphor film 12 is 20 μm and the lower limit of the thickness of the phosphor layer 13 for emitting light is 5 μm.

It is understood from FIG. 8 that, when the film thickness of the reflecting layer 14 is 15 μm, the refractive index of particles configuring the reflecting layer 14 can be set to 1.7 or higher in order to obtain the reflectivity of 85% or higher. Thereby, a higher luminance can be achieved in the full HD compliant plasma display panel 50 with high definition.

It is understood that, when the film thickness of the reflecting layer 14 is 10 μm, the refractive index of particles configuring the reflecting layer 14 can be set to 1.9 or higher in order to obtain the reflectivity of 85% or higher. It is further understood that, when the film thickness of the reflecting layer 14 is 5 μm, the refractive index of particles configuring the reflecting layer 14 can be set to 2.7 or higher in order to obtain the reflectivity of 85% or higher.

Accordingly, when the film thickness of the phosphor layer 13 configuring the phosphor film 12 is 5 μm, it is possible to form a larger discharge space 15 by setting the film thickness of the reflecting layer 14 to 15 μm (refractive index of 1.7 or higher), 10 μm (refractive index of 1.9 or higher), and 5 μm (refractive index of 2.7 or higher). Note that, the film thickness of the reflecting layer 14 can be made thinner according to increase of the refractive index, but the lower limit thereof is 180 μm or more because the average particle diameter Dm of particles configuring the reflecting layer 14 is 180 nm or more.

Figure 11:
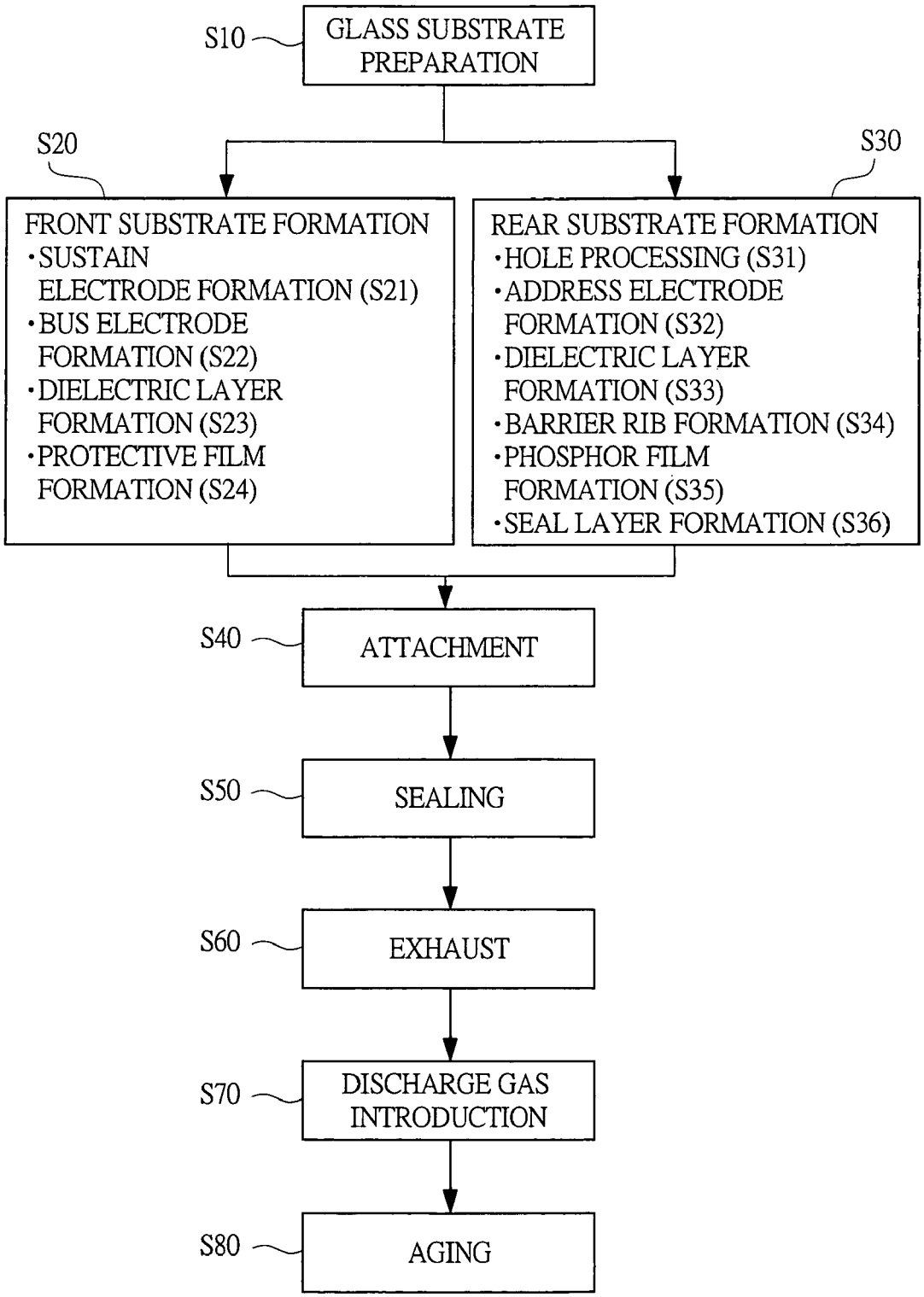
FIG. 11 is a process flow diagram of a plasma display panel according to an embodiment of the present invention.

Next, manufacturing steps of the plasma display panel 50 will be explained with reference to a process flowchart (FIG. 11) of the plasma display panel 50 according to the embodiment.

First, a glass substrate 1*a* configuring the front substrate 1 and a glass substrate 2*a* configuring the rear substrate 2, cut to predetermined sizes and cleaned, are prepared (S10). Next, the front substrate 1 and the rear substrate 2 are formed (S20, S30). The front substrate 1 is formed via respective steps of sustain electrode formation (S21), bus electrode formation (S22), dielectric layer formation (S23), and protective film formation (S24). The rear substrate 2 is formed via respective steps of hole processing (S31), address electrode formation (S32), dielectric layer formation (S33), barrier rib formation (S34), phosphor film formation (S35), and seal layer formation (S36).

In the sustain electrode formation (S21), a transparent ITO film is first formed on the glass substrate 1*a* using sputtering, vapor deposition, or CVD (Chemical Vapor Deposition) method. Next, after cleaned, sustain electrodes (X electrodes 3, Y electrodes 4) is formed by patterning the ITO film using photolithography technique and etching technique. Note that, tin oxide ($SnO_2$) may be used besides the ITO film configuring the sustain electrodes.

In the bus electrode formation (S22), after printing or applying of photosensitive silver paste is performed, bus electrodes (X bus electrodes 5, Y bus electrodes 6) are formed on the sustain electrodes using photolithography technique. Note that, a stacked film of chromium/copper/chromium formed by sputtering may be used besides the silver film configuring the bus electrode. The chromium is used for improving adhesion between copper and the glass substrate and preventing oxidation of copper.

In the dielectric layer formation (S23), the bus electrode is first covered with dielectric paste containing $SiO_2$ as a main component using screen printing method, resin component is removed by heat treatment, glass powder is melted/softened, and a dielectric layer 7 with a thickness (for example, 20 to 40 μm) is formed.

In the protective film formation (S24), a protective film 8 made from MgO is formed on the dielectric layer 7, for example, by electron beam deposition. When only the dielectric film 7 is formed, the dielectric film 7 is damaged by ion bombardment due to discharge, a secondary electron yield required for plasma discharge lowers and discharge voltage also rises. In order to prevent these problems, MgO is used as the protective film 8 resistant to ion bombardment and having a high secondary electron yield.

In the hole processing (formation) (S31), a hole is processed (formed) on the glass substrate 2*a* for vacuum exhausting from and discharge gas introducing into the discharge space 15 which are conducted at a later step. Note that, the hole is not shown in FIGS. 1 to 3, and it is formed at an end of the glass substrate 2*a*.

In the address electrode formation (S32), after printing or applying of photosensitive silver paste is performed, address electrodes 9 are formed on the glass substrate 2*a* using photolithography technique like the bus electrode formation (S22).

In the dielectric layer formation (S33) also, the address electrodes 9 are covered with dielectric paste containing $SiO_2$ as main component using screen printing method, resin component is removed by heat treatment, glass powder is melted/softened, and a dielectric layer 10 is formed with a thickness (for example, 20 to 40 μm) like the dielectric layer formation (S23) for the front substrate 1.

In the barrier rib formation (S34), barrier ribs 11 are formed on the dielectric layer 10, for example, using sandblast method. Specifically, glass paste which is the material for the barrier ribs 11 is first applied on a surface of the rear substrate 2 and dried. Next, after a patterned resist film is formed using photolithography technique, a glass paste film which is not covered with the resist pattern is cut by blowing a polishing material (abrasive) such as alumina to the glass paste film with high pressure so that the barrier ribs 11 are formed.

In the phosphor film formation (S35), after a reflecting layer 14 made from titanium oxide ($TiO_2$) is formed, for example, by thick film printing, sol-gel coating, or vapor deposition, phosphor layers 13 for red, green, and blue are respectively formed on a predetermined region configuring a display region so as to cover the reflecting layer 14 by printing or the like. Thereby, a phosphor film 12 having a two-layered structure including the phosphor layer 13 and the reflecting layer 14 is formed. The phosphor film 12 with a film thickness of 20 μm is configured such that, for example, the film thickness of the phosphor layer 13 is 5 μm and the reflecting layer 14 with a refractive index of 1.7 or higher has a film thickness of 15 μm.

In the seal layer formation (S36), a seal layer is formed by applying a paste-like glass material to an end portion of the glass substrate 2*a*. Since the sealing layer is lower than other dielectric materials regarding a baking temperature, formed for bonding the front substrate 1 and the rear substrate 2, and formed for maintaining air-tightness of the discharge space 15 after gas is filled in the discharge space 15.

Subsequently, the front substrate 1 and the rear substrate 2 are bonded to each other with high accuracy (S40), and, after being fixed to each other using a clip excellent in heat resistance, the sealing layer is melted by heat treatment so that the front substrate 1 and the rear substrate 2 are bonded (sealed) (S50) to form panel. Next, atmosphere in the discharge space 15 is exhausted (S60), and discharge gas is introduced into the discharge space 15 (S70). Thereafter, the hole on the rear substrate 2 is closed and aging is performed by lighting confirmation conducted for a long time in order to stabilize initial discharge characteristic and initial luminescence characteristic of the sealed panel (S80). A plasma display panel 50 with high luminance is completed according to the steps described above.

Second Embodiment

In the first embodiment, the case that the phosphor portion is formed as the phosphor layer 13 and the reflecting portion is formed as the reflecting layer 14 has been explained. That is, the plasma display panel 50 where the reflecting layer 14 which is the reflecting portion is made of particles having average particle diameter in a range of 180 nm to 800 nm and the reflectivity of the reflecting portion is 85% or higher has been explained. In the present embodiment, a case that a reflecting layer is not used as the reflecting portion will be explained. The remaining configuration in the present embodiment is similar to that in the first embodiment.

Figure 12:
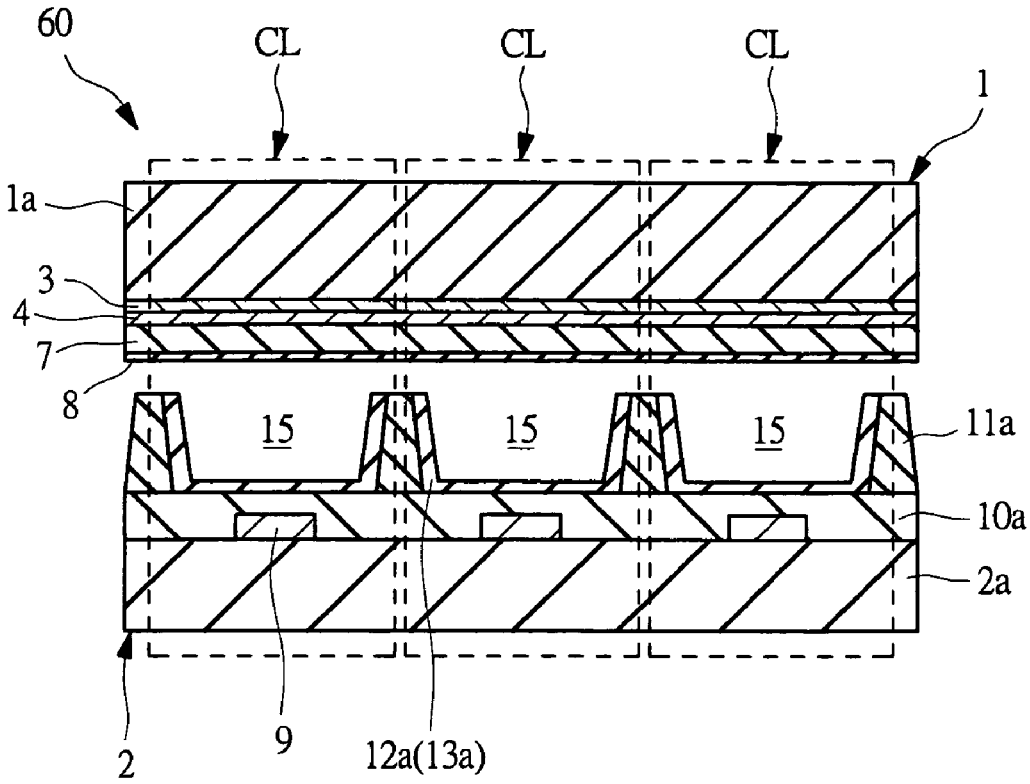
FIG. 12 is a cross-sectional view schematically showing a main part of a plasma display panel according to another embodiment of the present invention.

FIG. 12 is a cross-sectional view schematically showing a main part of a plasma display panel 60 in the present embodiment. In the present embodiment, a dielectric layer 10*a* and barrier ribs 11*a* which are phosphor film holding portion are provided as the reflecting portion, and a phosphor film 12*a* made of one phosphor layer 13*a* is provided on the phosphor film holding portion.

When an average particle diameter of fine particles configuring a reflecting portion material (for example, titanium oxide) contained in the dielectric layer 10*a* and the barrier rib 11*a* is set in a range of 180 nm to 800 nm, and the reflectivity of the dielectric layer 10*a* and the barrier rib 11*a* to visible rays is 85% or higher, the luminance of the plasma display panel 60 can be improved even if the phosphor film 12*a* (phosphor layer 13*a*) is made thin (for example, 5 μm). Since the reflecting layer 14 is not used in the plasma display panel 60, which is different from the first embodiment, a tolerance for the size of the discharge space 15 is increased corresponding to the size of the thickness of the reflecting layer 14. In other words, since the cell size of the discharge cell CL can be reduced corresponding to the size of the thickness of the reflecting layer 14, further high definition of the plasma display panel 60 can be achieved.

Third Embodiment

The structure of the plasma display panel 50 according to the first embodiment is of the surface discharge stripe type, which has been described in the above explanation. In a present embodiment, plasma display panels having various structures which are different from the structure in the first embodiment will be explained.

Figure 13:
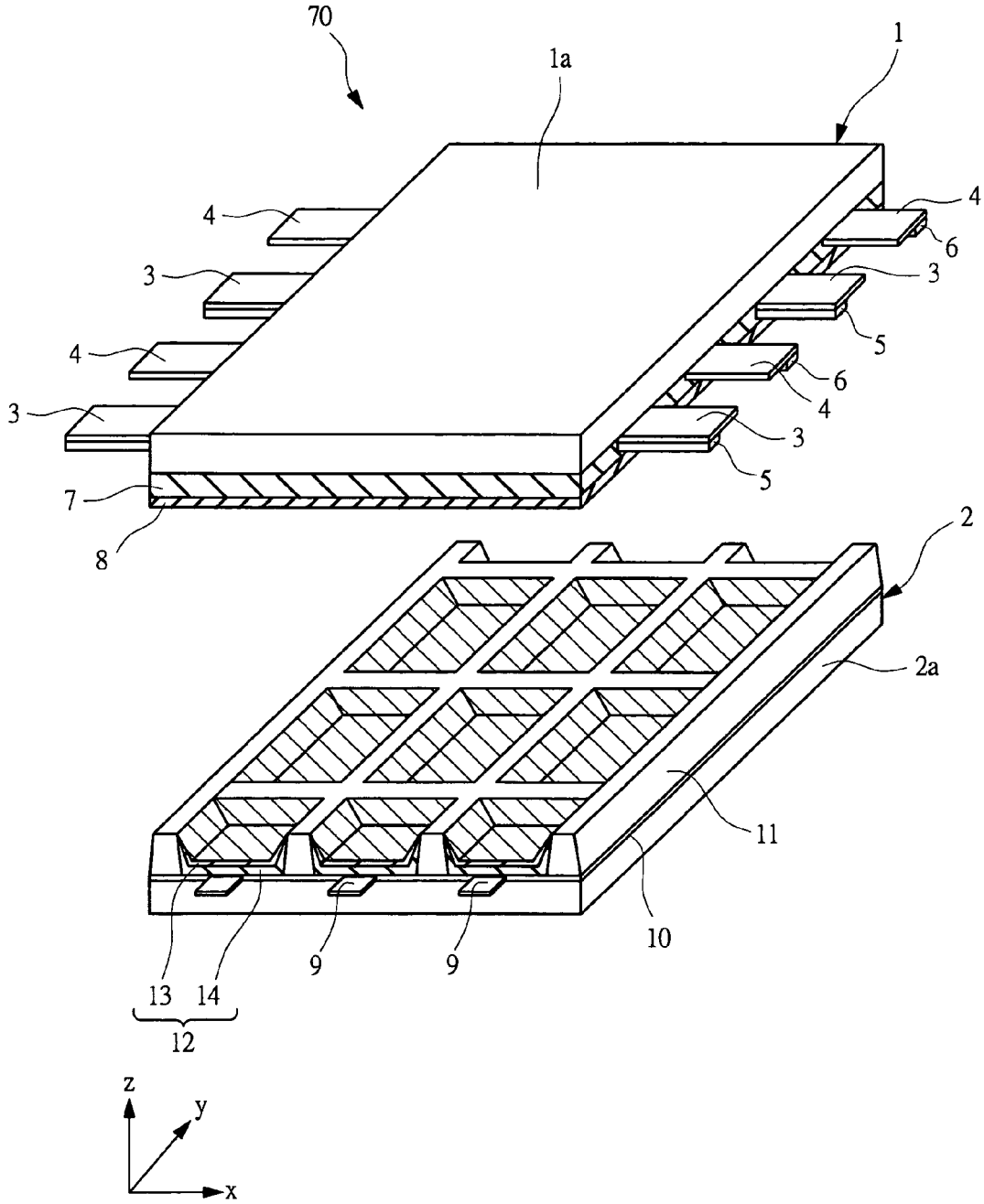
FIG. 13 is a cross-sectional view schematically showing a main part of a plasma display panel according to another embodiment of the present invention.
Figure 14:
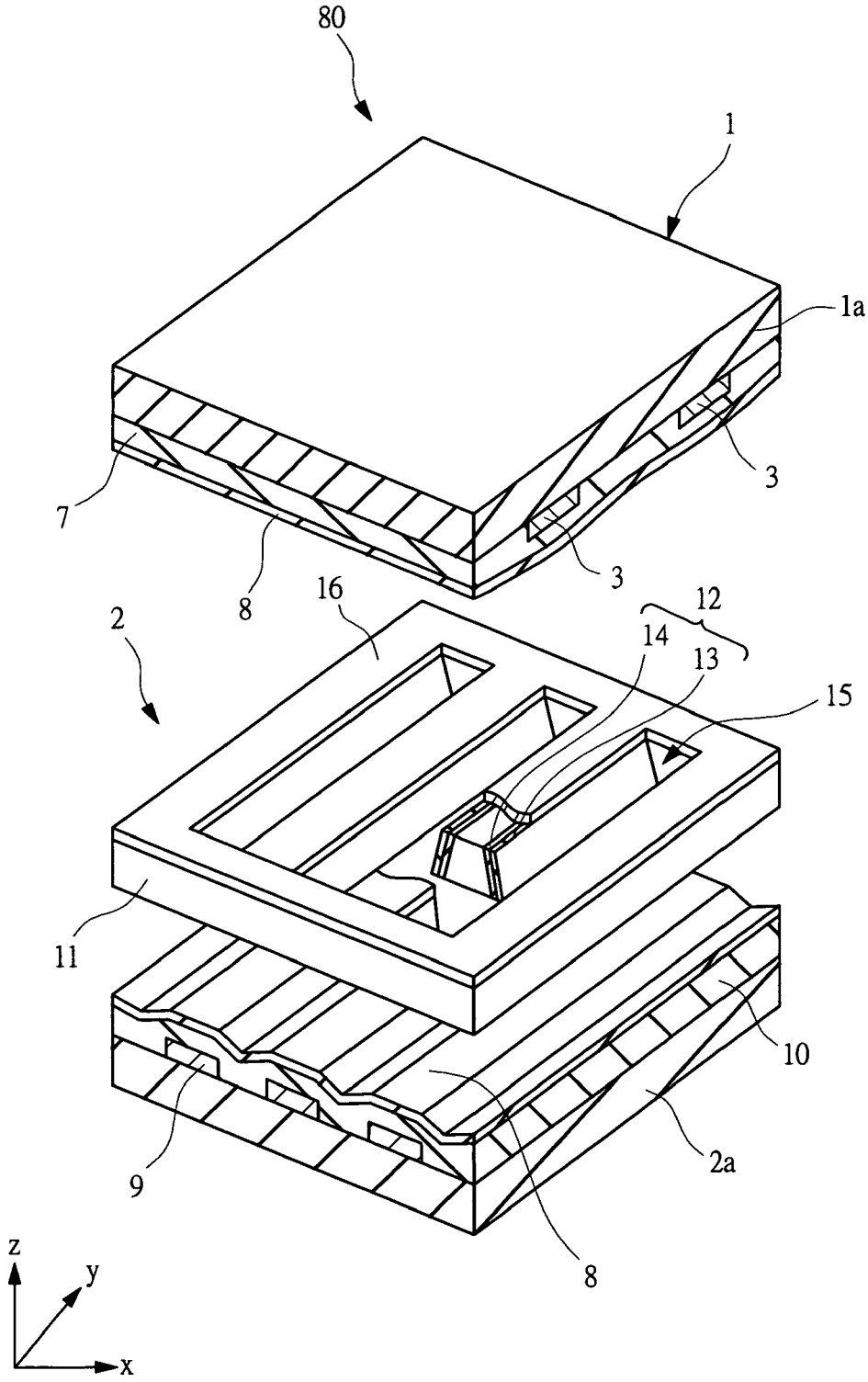
FIG. 14 is a cross-sectional view schematically showing a main part of a plasma display panel according to another embodiment of the present invention.
Figure 15:
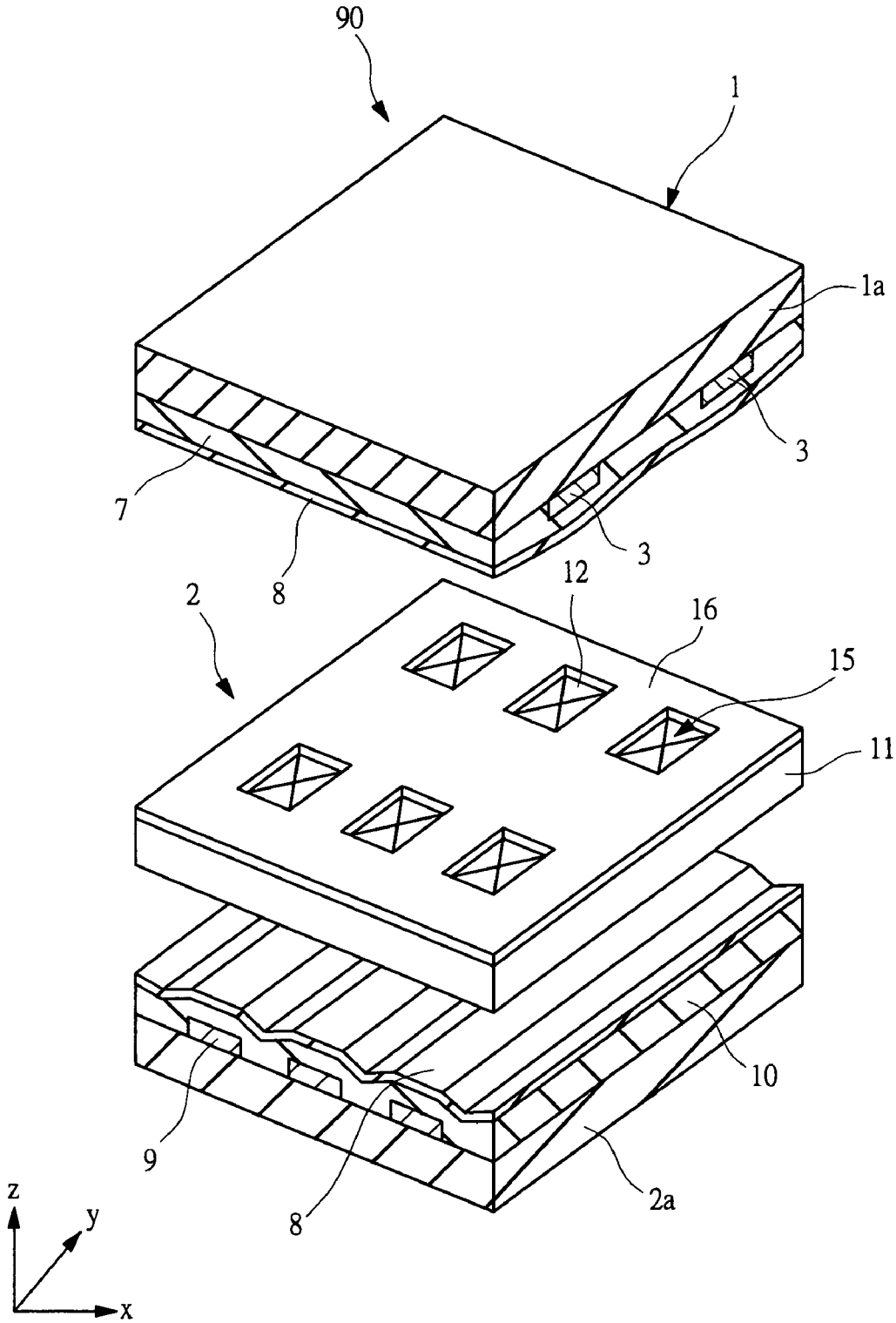
FIG. 15 is a cross-sectional view schematically showing a main part of a plasma display panel according to another embodiment of the present invention.

FIGS. 13 to 15 are perspective views schematically showing main parts of plasma display panels according to the present embodiment, FIG. 13 shows a plasma display panel 70 of a surface display box type, FIG. 14 shows a plasma display panel 80 of a diagonal discharge stripe type, and FIG. 15 shows a plasma display panel 90 of a diagonal discharge box type. Incidentally, in the plasma display panels 80 and 90, a black matrix 16 is used such that light emissions in adjacent discharge cells do not interface with each other.

In the plasma display panels 70, 80, and 90, a phosphor film 12 is configured to have a two-layered structure of a phosphor layer 13 (phosphor portion) and a reflecting layer 14 (reflecting portion) like the phosphor film 12 shown in the first embodiment. That is, when an average particle diameter of fine particles contained in the reflecting layer 14 (reflecting portion) is set in a range of 180 nm to 800 nm and the reflectivity of the reflecting layer 14 (reflecting portion) to visible rays is set 85% or higher, luminance of the plasma display panels 70, 80, and 90 can be improved even if the phosphor layer 13 is made thin (for example, 5 μm).

In the full HD compliant plasma display panels with high definition 70, 80, and 90, when the thickness of the phosphor layer 13 configuring the phosphor film 12 is set to 5 μm, higher luminance can be achieved by setting the film thickness of the reflecting layer 14 which is the other layer to 15 μm (refractive index of 1.7 or higher), 10 μm (refractive index of 1.9 or higher), or 5 μm (refractive index of 2.7 or higher).

Fourth Embodiment

In the present embodiment, a plasma display device using the plasma display panel 50 shown in the first embodiment will be explained. Since cases using the plasma display panels 60, 70, 80, and 90 shown in the second to third embodiments are similar to the case using the plasma display panel 50, explanation of plasma display devices using these plasma display panels 60, 70, 80, and 90 is omitted.

Figure 16:
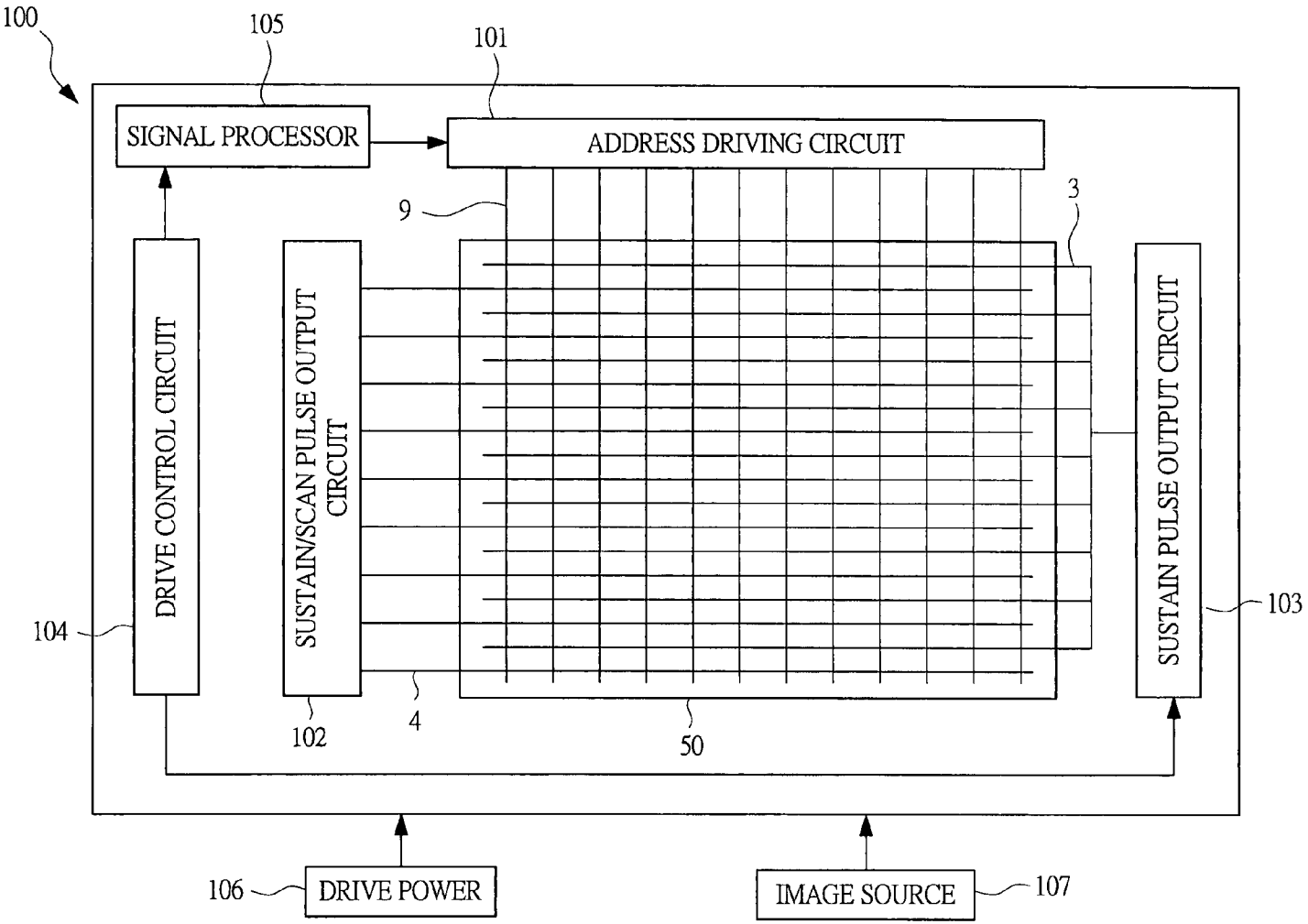
FIG. 16 is an explanatory diagram showing a configuration of a plasma display device according to an embodiment of the present invention.

FIG. 16 is an explanatory diagram showing a configuration of a plasma display device 100 of a surface discharge AC driving type according to the present embodiment. The plasma display device 100 is provided with the plasma display panel 50 including the address electrodes 9, the scan/sustain electrodes (Y electrodes 4), and the sustain electrodes (X electrodes 3), an address driving circuit 101 for driving the address electrodes 9, a scan/sustain pulse output circuit 102 for driving the scan/sustain electrodes (Y electrodes 4), a sustain pulse output circuit 103 for driving the sustain electrodes (X electrodes 3), a drive control circuit 104 for controlling the output circuits, and a signal processor 105 performing processing of an input signal. The plasma display device 100 is provided with a drive power 106 for applying voltage to the plasma display panel 50 and the like, and an image source 107 generating an image signal.

In the plasma display device 100, after the plasma display panel 50 is completed according to the manufacturing method shown in the first embodiment, electrodes of the plasma display panel 50 and a flexible substrate are joined by an anisotropic conductive film. Thereafter, for example, a board made from aluminum or the like is attached for improving heat radiation of the plasma display panel 50, and the drive power 106 and the drive circuits such as the address drive circuit 101 are assembled on the board, so that a plasma display module is completed. Thereafter, examination and the like are conducted, and the plasma display device 100 is completed by attaching an exterior case to the module.

As shown in FIGS. 1 to 3, the plasma display panel 50 is configured such that one (the rear substrate 2) of two glass substrates facing each other is provided with the address electrodes 9, and the other (the front substrate 1) thereof is provided with the scan/sustain electrodes (Y electrodes 4) and the sustain electrodes (X electrodes 3). A gap defined by the front substrate 1 and the rear substrate 2 is sectioned by the barrier ribs 11, and discharge cells CL are configured by respective discharge spaces 15 sectioned. Mixed gas such as, for example, Ne+Xe is filled in the discharge cells CL, when voltage is applied to the scan/sustain electrodes (Y electrodes 4) and the sustain electrodes (X electrodes 3), discharge takes place so that ultraviolet light generated. Phosphor emitting light of either one of red, green and blue is applied to each discharge cell CL, where the phosphor is excited by ultraviolet lights generated as described above so that color light corresponding to the phosphor is emitted. Color image display can be performed by utilizing the light emission to select a discharge cell of a desired color in response to an image signal.

In the plasma display device 100, the plasma display panel 50 shown in the first embodiment is used, an average particle size of fine particles contained in the reflecting layer 14 (reflecting portion) is set in a range of 180 nm to 800 nm, and the reflectivity of the reflecting layer 14 (reflecting portion) to visible rays is set to 85% or higher. Therefore the luminance of the plasma display panel 50 can be improved even if the phosphor layer 13 is made thin (for example, 5 μm).

Further, in the full HD compliant plasma display panel 50 with high definition 50, when the thickness of the phosphor layer 13 configuring the phosphor film 12 is set to 5 μm, a plasma display panel with a high luminance 50 can be obtained by setting the film thickness of the reflecting layer 14 which is the other layer to 15 μm (refractive index of 1.7 or higher), 10 μm (refractive index of 1.9 or higher), or 5 μm (refractive index of 2.7 or higher).

Thus, using the plasma display panel 50 shown in the first embodiment in this manner can realize a plasma display device 100 with high luminance and high definition 100.

In the foregoing, the invention made by the inventors of the present invention has been concretely described based on the embodiments. However, it is needless to say that the present invention is not limited to the foregoing embodiments and various modifications and alterations can be made within the scope of the present invention.

For example, in the first embodiment, the case that the phosphor film comprises two layers of a phosphor layer and a reflecting layer has been explained, but the present invention can be applied to a case including a plurality of layers, for example, a case including a total three layers of a phosphor layer and two reflecting layers, or a case including a total three layers of two phosphor layers and a reflecting layer, if the plurality of layers comprises at least one phosphor layer (phosphor portion) and one reflecting layer (reflecting portion).

The present invention can be widely utilized in manufacturing of a thin-model flat display with a large screen, especially, a plasma display panel including a phosphor film comprising a two-layered structure of a phosphor layer and a reflecting layer, and a plasma display device using the same.

What is claimed is:

1. A plasma display panel, comprising:
a discharge cell having:
a discharge space;
a phosphor film which contacts with the discharge space;
a holding portion which sections the discharge space and holds the phosphor film on an opposite side to the discharge space side; and
gas which is filled in the discharge space to emit ultraviolet light by discharge,
wherein the phosphor film comprises a phosphor layer which emits visible rays by excitation caused by ultraviolet light and a reflecting layer reflecting visible rays,
the phosphor layer is provided between the reflecting layer and the discharge space,
a film thickness of the reflecting layer is 15 μm or less, and
the refractive index of the reflecting layer is 1.7 or more.

2. The plasma display panel according to claim 1,
wherein the film thickness of the reflecting layer is 10 μm or less, and
the refractive index of the reflecting layer is 1.9 or more.

3. The plasma display panel according to claim 1,
wherein the film thickness of the reflecting layer is 5 μm or less, and
the refractive index of the reflecting layer is 2.7 or more.

4. The plasma display panel according to claim 1,
wherein the film thickness of the reflecting layer is 180 nm or more.

5. The plasma display panel according to claim 1,
wherein an average particle size of particles contained in the reflecting layer is in a range of 180 nm to 800 nm.

6. The plasma display panel according to claim 1,
wherein a reflectivity of the reflecting layer to visible rays is 85% or higher.

7. The plasma display panel according to claim 1,
wherein a film thickness of the phosphor film is 5 μm or more.

8. The plasma display panel according to claim 1,
wherein a film thickness of the phosphor film is 20 μm or less.

9. A plasma display device having a plasma display panel, comprising:
a discharge cell having:
a discharge space;
a phosphor film which contacts with the discharge space;
a holding portion which sections the discharge space and holds the phosphor film on an opposite side to the discharge space side; and
gas which is filled in the discharge space to emit ultraviolet light by discharge,
wherein the phosphor film comprises a phosphor layer which emits visible rays by excitation caused by ultraviolet light and a reflecting layer reflecting visible rays,
the phosphor layer is provided between the reflecting layer and the discharge space,
a film thickness of the reflecting layer is 15 μm or less, and
the refractive index of the reflecting layer is 1.7 or more.

10. The plasma display device according to claim 9,
wherein the film thickness of the reflecting layer is 10 μm or less, and
the refractive index of the reflecting layer is 1.9 or more.

11. The plasma display device according to claim 9,
wherein the film thickness of the reflecting layer is 5 μm or less, and
the refractive index of the reflecting layer is 2.7 or more.

12. The plasma display device according to claim 9,
wherein the film thickness of the reflecting layer is 180 nm or more.

13. The plasma display device according to claim 9,
wherein an average particle size of particles contained in the reflecting layer is in a range of 180 nm to 800 nm.

14. The plasma display device according to claim 9,
wherein a reflectivity of the reflecting layer to visible rays is 85% or higher.

15. The plasma display device according to claim 9,
wherein a film thickness of the phosphor film is 5 μm or more.

16. The plasma display device according to claim 9,
wherein a film thickness of the phosphor film is 20 μm or less.

* * * * *